US007737935B2

(12) United States Patent
Kim

(10) Patent No.: US 7,737,935 B2
(45) Date of Patent: Jun. 15, 2010

(54) METHOD OF DRIVING LIQUID CRYSTAL DISPLAY DEVICE

(75) Inventor: Seong-Gyun Kim, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 1197 days.

(21) Appl. No.: 11/296,047

(22) Filed: Dec. 6, 2005

(65) Prior Publication Data

US 2006/0290644 A1 Dec. 28, 2006

(30) Foreign Application Priority Data

Jun. 28, 2005 (KR) ..... 10-2005-0056496

(51) Int. Cl.
*G09G 3/36* (2006.01)

(52) U.S. Cl. ..... 345/96; 345/100; 345/204; 349/37

(58) Field of Classification Search ..... 345/100, 345/204, 87, 92, 96, 98, 99; 349/37, 42; 327/333

See application file for complete search history.

(56) References Cited

U.S. PATENT DOCUMENTS 6,734,925 B1 * 5/2004 Lee et al. ..... 349/40
6,891,522 B2 * 5/2005 Song et al. ..... 345/87
7,391,401 B2 * 6/2008 Kim et al. ..... 345/96

FOREIGN PATENT DOCUMENTS

WO 2004/011996 A1 2/2004

OTHER PUBLICATIONS

Office Action issued in corresponding Chinese Patent Application No. 200510109286.8; issued Mar. 14, 2008.

* cited by examiner

*Primary Examiner*—Abbas I Abdulselam
(74) *Attorney, Agent, or Firm*—Brinks Hofer Gilson & Lione

(57) ABSTRACT

A method of driving a liquid crystal display device having a plurality of gate lines, a plurality of data lines and a plurality of pixel electrodes includes: applying sequentially a gate signal to the plurality of gate lines, the gate signal being applied to odd gates lines of the plurality of gate lines for a first pulse time period and being applied to even gate lines of the plurality of gate lines for a second pulse time period shorter than the first pulse time period; and supplying a data signal to each of the plurality of data lines.

14 Claims, 8 Drawing Sheets

P

| | | | | |
|---|---|---|---|---|
| GL1 | + | − | + | − |
| GL2 | − | + | − | + |
| GL3 | − | + | − | + |
| GL4 | + | − | + | − |

(second frame)

*FIG. 5D*

P

| | | | | |
|---|---|---|---|---|
| GL1 | − | + | − | + |
| GL2 | − | + | − | + |
| GL3 | + | − | + | − |
| GL4 | + | − | + | − |

(third frame)

*FIG. 5E*

P

| | | | | |
|---|---|---|---|---|
| GL1 | − | + | − | + |
| GL2 | + | − | + | − |
| GL3 | + | − | + | − |
| GL4 | − | + | − | + |

(fourth frame)

*FIG. 5F*

METHOD OF DRIVING LIQUID CRYSTAL DISPLAY DEVICE

This application claims the benefit of Korean Patent Application No. 2005-0056496, filed on Jun. 28, 2005, which is hereby incorporated by reference for all purposes as if set forth herein.

BACKGROUND OF THE INVENTION

1. Field of the Invention

The present invention relates to a liquid crystal display (LCD) device, and more particularly, to a method of driving a LCD device.

2. Discussion of the Related Art

Flat panel display (FPD) devices having portability and low power consumption have been subject of recent researches in the coming of the information age. Among the various types of FPD devices, liquid crystal display (LCD) devices are widely used as monitors for notebook computers and desktop computers because of their high resolution, ability to display colors and superiority in displaying moving images.

In general, a LCD device includes a first substrate, a second substrate and a liquid crystal layer between the first and second substrates. The LCD device uses the optical anisotropy and polarization properties of liquid crystal molecules to produce an image. Due to the optical anisotropy of the liquid crystal molecules, refraction of light incident onto the liquid crystal molecules depends upon the alignment direction of the liquid crystal molecules. The liquid crystal molecules have long thin shapes that can be aligned along specific directions. The alignment direction of the liquid crystal molecules can be controlled by applying an electric field. Accordingly, the alignment of the liquid crystal molecules changes in accordance with the direction of the applied electric field. Thus, by properly controlling the electric field applied to a group of liquid crystal molecules within respective pixel regions, a desired image can be produced by appropriately modulating transmittance of the incident light.

FIG. 1 is a schematic view showing a liquid crystal display device according to the related art. In FIG. 1, a LCD device includes a liquid crystal panel 100, a gate driver 120, a data driver 110, and a timing controller 130. A plurality of gate lines "GL1" to "GLn" and a plurality of data lines "DL1" to "DLm" are formed in the liquid crystal panel 100. The plurality of gate lines "GL1" to "GLn" and the plurality of data lines "DL1" to "DLm" cross each other to define a plurality of pixel regions "P." A thin film transistor "T" is connected to the gate line and the data line, and a liquid crystal capacitor "LC" connected to the transistor "T" is formed in each pixel region. The charging of the liquid crystal capacitor is controlled by the ON/OFF state of the transistor "T," thereby modulating transmittance of incident light.

When a gate signal is applied to a selected one of the plurality of gate lines "GL1" to "GLn," the transistor "T" connected to the selected gate line is turned ON and a data signal applied to the plurality of data lines "DL1" to "DLm" is supplied to the liquid crystal capacitor "LC." When a gate signal is not applied, the transistor is turned OFF and the liquid crystal capacitor "LC" keeps the charged data signal until the next frame. Even though not shown in FIG. 1, the liquid crystal capacitor "LC" may be defined by a pixel electrode on a first substrate, a common electrode on a second substrate and a liquid crystal layer between the pixel electrode and the common electrode. Furthermore, a storage capacitor (not shown) may be connected to the transistor to keep the charged data signal stable. Accordingly, an alignment state of liquid crystal molecules in the liquid crystal layer is controlled according to the charged data signal in the liquid crystal capacitor "LC," thereby modulating the transmittance of incident light and displaying images.

The gate driver 120 receives control signals from the timing controller 130, and sequentially applies the gate signal to the plurality of gate lines "GL1" to "GLn" to turn ON transistor "T." The data driver 110 receives control signals and an image signal from the timing controller 130, and supplies the data signal corresponding to one horizontal line to the plurality of data lines "DL1" to "DLm" in sync with the gate signal. The timing controller 130 receives the control signals and the image signal from an exterior circuit (not shown), and supplies the control signals and the image signal to the gate driver 120 and the data driver 110.

FIG. 2 is a schematic block diagram showing a gate driver of a liquid crystal display device according to the related art. In FIG. 2, a gate driver includes a shift register unit 210, a level shifter unit 220 and an output buffer unit 230. The shift register unit 210 receives a horizontal sync signal and a vertical sync signal and sequentially generates a scan pulse. The level shifter unit 220 receives the scan pulse and converts the scan pulse to a voltage level capable of driving transistor "T" (of FIG. 1). The output buffer unit 230 stabilizes the converted scan pulse and supplies the stabilized scan pulse to the plurality of gate lines "GL1" to "GLn" as a gate signal.

FIG. 3 is a schematic timing chart showing gate signals for a liquid crystal display device according to the related art. In FIG. 3, a sequential scan method is used for driving a plurality of gate lines. In a sequential scan method, a gate signal is applied to a selected gate line for a single horizontal time period "$T_L$" and a plurality of gate signals are sequentially applied to the plurality of gate lines for a single horizontal time period.

As a LCD device increases in size, the number of gate lines and a resistance and a load capacitance of data lines increase. These increases reduce the time to charge a liquid crystal capacitor with image signals is reduced. As a result, a display quality of a LCD device is deteriorated due to a reduction in charge ratio.

SUMMARY OF THE INVENTION

The present invention is directed to a method of driving a liquid crystal display. A method is provided to drive a liquid crystal display device where a charge property of a LCD image is improved. Additionally, a method is provided to drive a liquid crystal display device where gate signals are applied to two adjacent gate lines for different time periods.

A method is disclosed for driving a liquid crystal display device having a plurality of gate lines, a plurality of data lines and a plurality of pixel electrodes. The method includes applying sequentially a gate signal to the plurality of gate lines. The gate signal is applied to odd gates lines of the plurality of gate lines for a first pulse time period. The gate signal is applied to even gate lines of the plurality of gate lines for a second pulse time period shorter than the first pulse time period. A data signal is supplied to the plurality of data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIGS. 5C to 5F are schematic views showing polarities of sequential four frames in a liquid crystal display device according to another embodiment of the present invention.

DETAILED DESCRIPTION OF THE ILLUSTRATED EMBODIMENTS

Reference will now be made in detail to embodiments of the present invention, examples of which are illustrated in the accompanying drawings. Wherever possible, similar reference numbers will be used to refer to the same or similar parts.

A LCD device comprises a plurality of gate lines and a plurality of data lines. In a present frame, a data signal having polarity is supplied to one or more data lines while the gate signal is applied to a pair of adjacent odd and even gate lines connected to the one or more data lines. Subsequently, a data signal having the opposite polarity is sequentially supplied to one or more data lines while the gate signal is applied to the next pair of adjacent odd and even gate lines connected to the one or more data lines. For example, in a present frame, a data signal having a positive polarity is applied to one or more data lines (e.g., DL1, DL3, . . . , $DL_{m-1}$) while the gate signal is applied to a pair of adjacent gate lines, such as the first and second gate lines "GL1" and "GL2." Subsequently, a data signal having a negative polarity is applied to one or more data lines (e.g., DL1, DL3, . . . , $DL_{m-1}$) while the gate signal is applied to the third and fourth gate lines "GL3" and "GL4." In the next frame, the polarities of the data signals are inverted with respect to the present frame. Accordingly, a LCD device is driven by a two-line-frame-inversion method where a polarity of a data signal is inverted every two lines and every frame.

Figure 1:
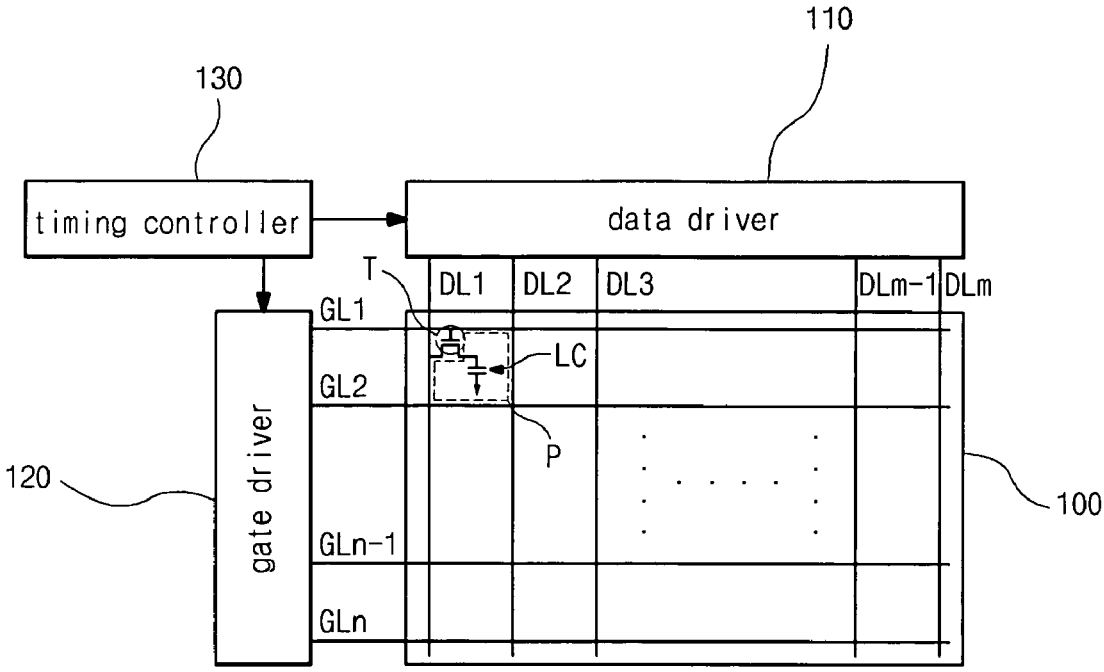
(related art) FIG. 1
FIG. 1 is a schematic view showing a liquid crystal display device according to the related art.
Figure 2:
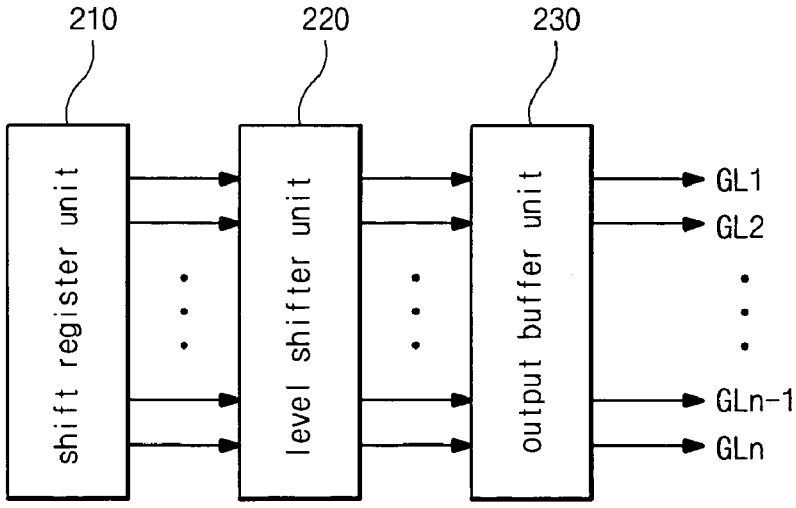
(related art) FIG. 2
FIG. 2 is a schematic block diagram showing a gate driver of a liquid crystal display device according to the related art.
Figure 3:
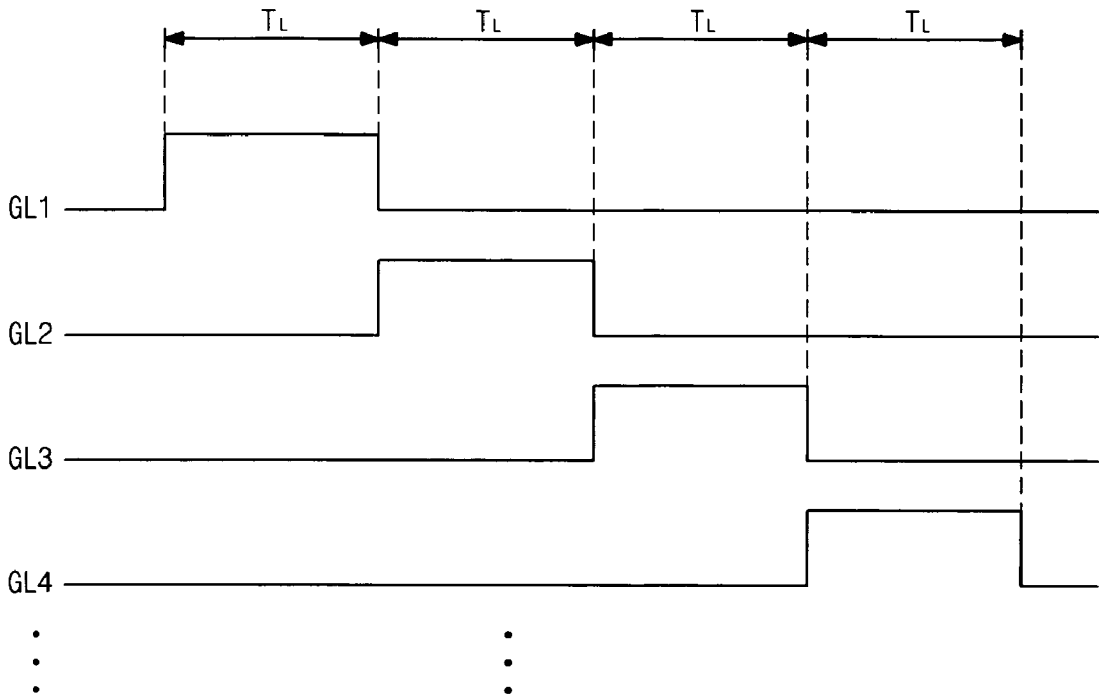
(related art) FIG. 3
FIG. 3 is a schematic timing chart showing gate signals for a liquid crystal display device according to the related art.
Figure 4A:
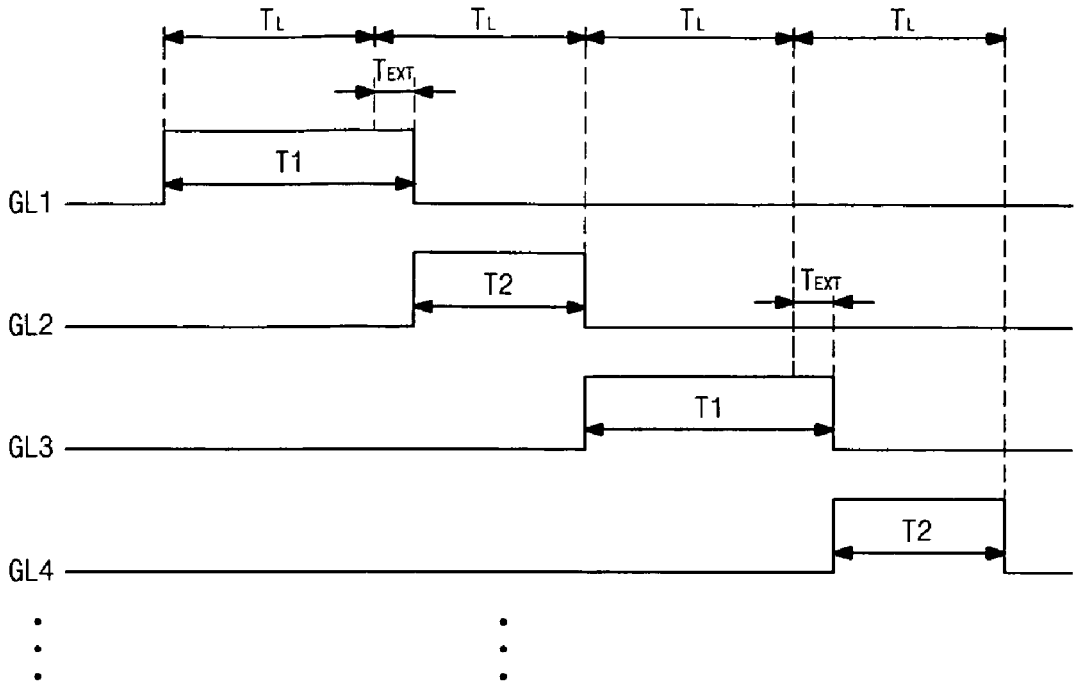
FIG. 4A is a schematic timing chart of a gate signal for driving a liquid crystal display device.

FIG. 4A shows a timing chart of a gate signal for driving a LCD. A gate signal is applied to odd gate lines "GL1" and "GL3" for a first pulse time period "T1," and applied to even gate lines "GL2" and "GL4" for a second pulse time period "T2," different from the first pulse time period "T1." For example, the first pulse time period "T1" may be determined as a sum of a single horizontal time period "$T_L$" and an extended time period "$T_{EXT}$" (e.g., $T1=T_L+T_{EXT}$). The second pulse time period "T2" may be determined as a difference between the single horizontal time period "$T_L$" and the extended time period "$T_{EXT}$" (e.g., $T2=T_L-T_{EXT}$). Accordingly, a time period for which the gate signal is applied to the odd gate lines is longer than a time period for which the gate signal is applied to the even gate lines. The single horizontal time period "$T_L$" may be obtained by dividing a time period for a single frame into the number of gate lines. The extended time period "$T_{EXT}$" may vary as a property of a LCD device. Since the gate signal is sequentially applied without cessation to a pair of adjacent odd and even gate lines (e.g., GL1 and GL2) for two horizontal time periods, "$2T_L$," a sum of the first and second pulse time period "T1" and "T2" does not vary even when the extended time period varies.

Figure 4B:
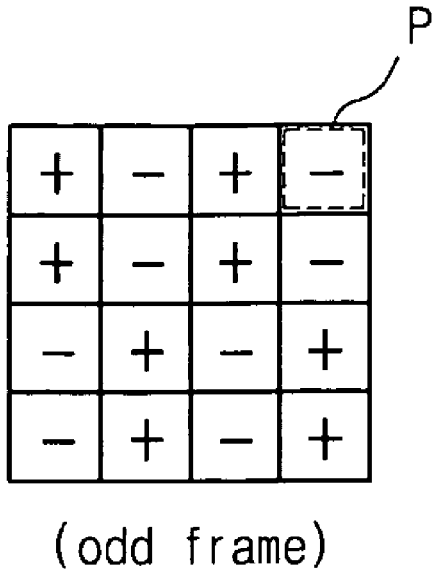
FIG. 4B is a schematic view showing polarities of an odd frame in a liquid crystal display device.
Figure 4C:
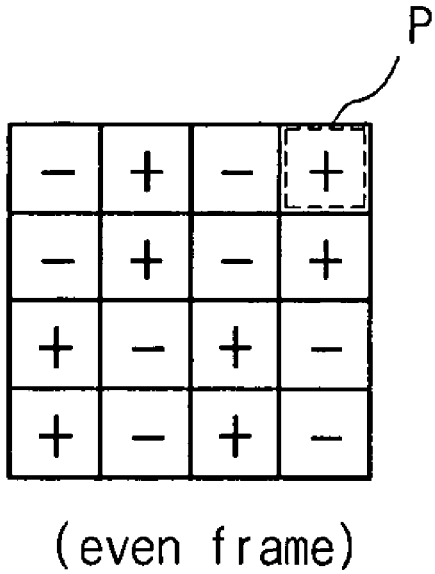
FIG. 4C is a schematic view showing polarities of an even frame in a liquid crystal display device according to an embodiment of the present invention.

FIG. 4B is a schematic view of polarities of an odd frame in a LCD. During an odd frame, the polarity of a data signal is inverted every two horizontal lines and in every pixel region "P" along the horizontal line. FIG. 4C is a schematic view of polarities of an even frame in a LCD. The polarity of a data signal is inverted in all of the pixel regions "P" with respect to an odd frame. Accordingly, the polarity of the data signal is inverted every frame.

In a LCD receiving the signals of FIG. 4A and generating the polarities of FIGS. 4B and 4C, a data signal having the same polarity is supplied to one or more data lines while the gate signal is sequentially applied to a pair of adjacent odd and even gate lines connected to the one or more data lines. In other words, two adjacent odd and even gate lines constitute a gate line pair, and a polarity of a data signal corresponding to the odd gate line of the gate line pair is substantially equal to a polarity of a data signal corresponding to the even gate line of the gate line pair.

The gate signal is applied to a first gate line of a pair of adjacent odd and even gate lines for the first pulse time period "T1" longer than the single horizontal time period "$T_L$" (e.g., $T1=T_L+T_{EXT}$), and applied to a second gate line of the pair of adjacent odd and even gate lines for the second pulse time period "T2" shorter than the single horizontal time period "$T_L$" (e.g., $T2=T_L-T_{EXT}$). Since a data signal having equal polarity is supplied to the data line for the first pulse time period "T1" longer than the single horizontal time period "$T_L$," the pixel region "P" corresponding to the first gate line is sufficiently charged by the data signal. Furthermore, since a data signal for the first gate line has the same polarity as the data signal for the second gate line, the data lines connected to the second gate line are already partially charged. Accordingly, the pixel region "P" corresponding to the second gate line is also sufficiently charged by the data signal even for the second pulse time period "T2" shorter than the single horizontal time period "$T_L$."

In a first method of driving a LCD device, a gate signal is applied sequentially to a pair of adjacent odd and even gate lines for two horizontal time periods while a data signal having equal polarities is supplied to one or more data lines. The data signals are supplied to the one or more data lines and charge a pixel region corresponding to a first gate line for a first pulse time period longer than the single horizontal time period, and charge a pixel region corresponding to a second gate line for a second pulse time period shorter than the single horizontal time period. Since the pixel region corresponding to the first gate line is charged for the longer first time and the data line is pre-charged with a data signal having equal polarity, the pixel regions corresponding to the first and second gate lines are sufficiently charged. Accordingly, a charge property of a LCD image is improved.

However, since the data signals are inverted every frame, the pixel region corresponding to the second gate line may not be sufficiently charged for the shorter time period in the next frame. Since the polarity of the data signal in an odd frame is opposite to the polarity of the data signal in an even frame, an effect of a charge property improvement may be reduced. To improve the above drawbacks, an alternate driving method of a LCD device may be used.

Figure 5A:
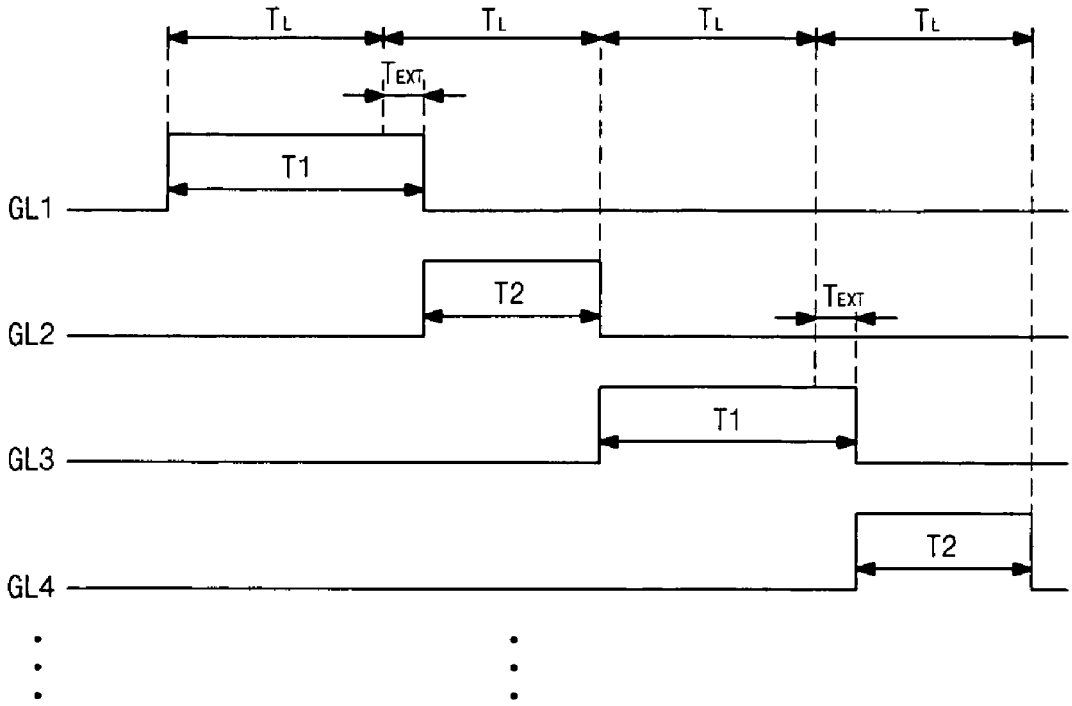
FIGS. 5A and 5B are schematic timing charts showing gate signals for a method of driving a liquid crystal display device according to another embodiment of the present invention.
Figure 5B:
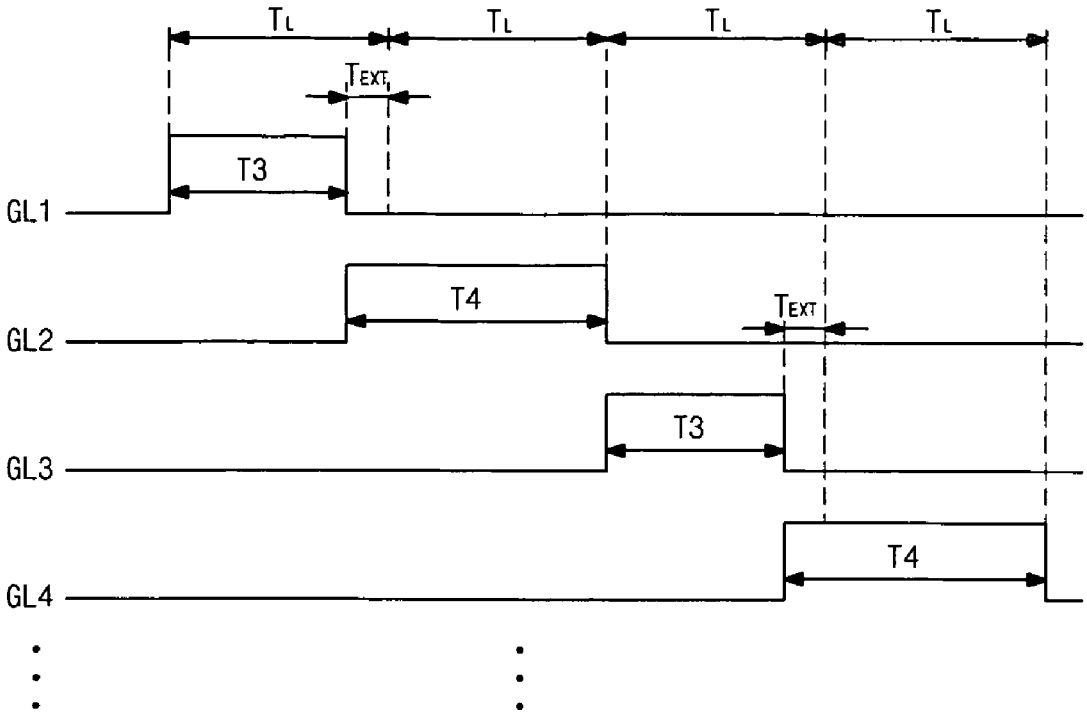

FIGS. 5A and 5B are schematic timing charts showing gate signals for a method of driving a liquid crystal display device according to another embodiment of the present invention, and FIGS. 5C to 5F are schematic views showing polarities of sequential four frames in a liquid crystal display device according to another embodiment of the present invention.

In an odd frame, a data signal having polarity is supplied to one or more data lines while the gate signal is applied to a pair of adjacent odd and even gate lines. A data signal having opposite polarity is sequentially supplied to one or more data lines while the gate signal is applied to the next pair of adjacent odd and even gate lines. In an even frame, a data signal having polarities opposite to each other is supplied to one or more data lines while the gate signal is applied to a pair of adjacent odd and even gate lines. A data signal having polarities opposite to each other is sequentially supplied to one or more data lines while the gate signal is applied to the next pair of adjacent odd and even gate lines. For example, in an odd frame, a data signal having a positive polarity may be supplied to one or more data lines while the gate signal is applied to a pair of adjacent odd and even gate lines, such as the first and second gate lines "GL1" and "GL2." While still within the odd frame, a data signal having a negative polarity is sequentially supplied to one or more data lines while the gate signal is applied to the next pair of adjacent odd and even gate lines, such as the third and fourth gate lines "GL3" and "GL4." In an even frame, a data signal having positive and negative polarities may be supplied to one or more data lines while the gate signal is applied a pair of adjacent odd and even gate lines, such as the first and second gate lines "GL1" and "GL2." While still within the even frame, a data signal having negative and positive polarities may be supplied to one or more data lines while the gate signal is applied to the next pair of adjacent odd and even gate lines, such as the third and fourth gate lines "GL3" and "GL4." Accordingly, a LCD device is driven by a two-line-two-frame-inversion method where polarity of a data signal is inverted every two lines and every two frames.

In FIG. 5A, for an odd frame, a gate signal is applied to odd gate lines "GL1" and "GL3" for a first pulse time period "T1," and is applied to even gate lines "GL2" and "GL4" for a second pulse time period "T2," different from the first pulse time period "T1." For example, the first pulse time period "T1" may be determined as a sum of a single horizontal time period "$T_L$" and an extended time period "$T_{EXT}$" (e.g., $T1=T_L+T_{EXT}$), and the second pulse time period "T2" may be determined as a difference between the single horizontal time period "$T_L$" and the extended time period "$T_{EXT}$" (e.g., $T2=T_L-T_{EXT}$). Accordingly, a time period for which the gate signal is applied to the odd gate lines is longer than a time period for which the gate signal is applied to the even gate lines in an odd frame. Furthermore, in an odd frame, a data signal having equal polarities is supplied to one or more data lines for the first and second pulse time periods "T1" and "T2." During the next frame, odd frame, the equal polarities of the data signal are inverted.

In FIG. 5B, for an even frame, a gate signal is applied to odd gate lines "GL1" and "GL3" for a third time period "T3," and is applied to even gate lines "GL2" and "GL4" for a fourth time period "T4," different from the third time period "T3." For example, the third time period "T3" may be determined as a difference between a single horizontal time period "$T_L$" and an extended time period "$T_{EXT}$" (e.g., $T3=T_L-T_{EXT}$), and the fourth time period "T4" may be determined as a sum of the single horizontal time period "$T_L$" and the extended time period "$T_{EXT}$" (e.g., $T4=T_L+T_{EXT}$). Accordingly, a time period for which the gate signal is applied to the odd gate lines is shorter than a time period for which the gate signal is applied to the even gate lines in an even frame. Furthermore, in an even frame, a data signal having opposite polarities is supplied to one or more data lines for the third and fourth time periods "T3" and "T4." During the next even frame, the opposite polarities of the data signal are inverted.

The single horizontal time period "$T_L$" may be obtained by dividing a time period for a single frame into the number of gate lines. The extended time period "$T_{EXT}$" may vary as a property of a LCD device. Since the gate signal is sequentially applied without cessation to a pair of adjacent odd and even gate lines (e.g., GL1 and GL2) for two horizontal time periods, "$2T_L$," a sum of the first and second pulse time periods "T1" and "T2," and a sum of the third and fourth time period "T3" and "T4" do not vary even when the extended time period varies.

Figure 5C:
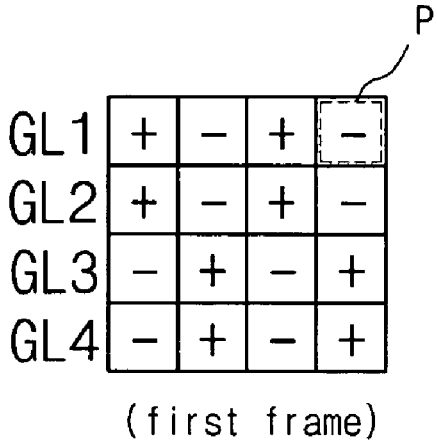

In FIG. 5C, for a first frame, a data signal having equal first polarities are supplied to through one or more data lines to the pixel regions "P" corresponding to a pair of adjacent odd and even gate lines. Furthermore, the data signal having equal second polarities opposite to the first polarities is supplied through one or more data lines to the pixel regions "P" corresponding to the next pair of adjacent odd and even gate lines. For example, a data signal having positive polarities may be supplied to the pixel regions "P" corresponding to a pair of adjacent odd and even data lines, such as the first and second gate lines "GL1" and "GL2," and a data signal having negative polarities may be supplied to the pixel regions corresponding to the next pair of adjacent odd and even data lines, such as the third and fourth gate lines "GL3" and "GL4." As a result, the polarities of the data signal supplied to the pixel regions corresponding to the first gate line "GL1" is equal to the polarities of the data signal supplied to the pixel regions corresponding to the second gate line "GL2," and the polarities of the data signal supplied to the pixel regions corresponding to the third gate line "GL3" is equal to the polarities of the data signal supplied to the pixel regions corresponding to the fourth gate line "GL4." As shown in FIG. 5A, the first pulse time period for the odd gate lines, for example, the first and third gate lines "GL1" and "GL3," is longer than the second pulse time period for the even gate lines, for example, the second and fourth gate lines "GL2" and "GL4." Since the data line is already charged with the data signal having the equal polarities, a pixel electrode (not shown) of the pixel region corresponding to the even gate lines is sufficiently charged even for the shorter second pulse time period. Furthermore, in FIG. 5C, the data signal supplied to the horizontally adjacent pixel regions corresponding to the selected gate line has opposite polarities.

In FIG. 5D for a second frame, the polarities of data signals supplied to the pixel regions "P," through one or more data lines, corresponding to the even gate lines are inverted with respect to the first frame. For example, polarities of a data signal supplied to the pixel regions "P," through one or more data lines, corresponding to the second and fourth gate lines "GL2" and "GL4" may be inverted, while polarities of a data signal supplied to the pixel regions "P," through one or more data lines, corresponding to the first and third gate lines "GL1" and "GL3" may not be inverted. As a result, a data signal supplied to the pixel regions corresponding to a pair of adjacent even and odd gate lines has equal polarities. For example, the polarities of a data signal supplied to the pixel regions corresponding to the second gate line "GL2" may be equal to the polarities of the data signal supplied to the pixel regions corresponding to the third gate line "GL3."

As shown in FIG. 5B, the third time period for the odd gate lines such as the first and third gate lines "GL1" and "GL3" is shorter than the fourth time period for the even gate lines such as the second and fourth gate lines "GL2" and "GL4." Since one or more data lines is already charged with the data signal having equal polarities, a pixel electrode (not shown) of the pixel region corresponding to the odd gate lines is sufficiently charged even for the shorter third time period. For example, since one or more data lines is already charged with a data signal supplied to the pixel regions corresponding to the second gate line "GL2," the pixel electrode of the pixel regions corresponding to the third gate line "GL3" can be sufficiently charged even for the shorter third time period.

Furthermore, since the pixel electrodes of the pixel regions corresponding to the odd gate lines are charged with a data signal having equal polarities in the previous frame, the pixel electrodes of the pixel region corresponding to the odd gate lines are sufficiently charged even for the shorter third time period in the present frame. For example, since the pixel electrode of the pixel regions corresponding to the third gate line "GL3" is already charged with a data signal having negative polarity in the first frame, the pixel electrode of the pixel regions corresponding to the third gate line "GL3" may be sufficiently charged with a data signal having negative polarity in the second frame even for the shorter third time period.

In FIG. 5E for a third frame, the polarities of data signals supplied to the pixel regions "P" corresponding to the odd gate lines are inverted with respect to the second frame. For example, polarities of a data signal supplied to the pixel regions "P," through one or more data lines, corresponding to the first and third gate lines "GL1" and "GL3" may be inverted, while polarities of a data signal supplied to the pixel regions "P," through one or more data lines, corresponding to the second and fourth gate lines "GL2" and "GL4" may not be inverted. As a result, a data signal supplied to the pixel regions corresponding to a pair of adjacent odd and even gate lines has equal polarities as in the first frame. For example, the polarities of a data signal supplied to the pixel regions corresponding to the first gate line "GL1" may be equal to the polarities of the data signal supplied to the pixel regions corresponding to the second gate line "GL2."

As shown in FIG. 5A, the first pulse time period for the odd gate lines such as the first and third gate lines "GL1" and "GL3" is longer than the second pulse time period for the even gate lines such as the second and fourth gate lines "GL2" and "GL4." Since one or more data lines is already charged with a data signal having equal polarities, pixel electrodes (not shown) of the pixel regions corresponding to the even gate lines are sufficiently charged even for the shorter second pulse time period. For example, since one or more data lines is already charged with a data signal supplied to the pixel regions corresponding to the first gate line "GL1," the pixel electrodes of the pixel regions corresponding to the second gate line "GL2" can be sufficiently charged even for the shorter second pulse time period. Furthermore, since the pixel electrodes of the pixel regions corresponding to the even gate lines are charged with a data signal having equal polarities in the previous frame, the pixel electrodes of the pixel region corresponding to the even gate lines are sufficiently charged even for the shorter second pulse time period in the present frame. For example, since the pixel electrode of the pixel regions corresponding to the second gate line "GL2" is already charged with a data signal having negative polarity in the second frame, the pixel electrode of the pixel regions corresponding to the second gate line "GL2" may be sufficiently charged with a data signal having negative polarity in the third frame even for the shorter second pulse time period.

In FIG. 5F for a fourth frame, polarities of data signals supplied to the pixel regions "P," through one or more data lines, corresponding to the even gate lines are inverted with respect to the third frame. For example, polarities of a data signal supplied to the pixel regions "P," through one or more data lines, corresponding to the second and fourth gate lines "GL2" and "GL4" may be inverted, while polarities of a data signal supplied to the pixel regions "P," through one or more data lines, corresponding to the first and third gate lines "GL1" and "GL3" may not be inverted. As a result, a data signal supplied to the pixel regions corresponding to a pair of adjacent even and odd gate lines (e.g., GL2 and GL3) has equal polarities. For example, the polarities of a data signal supplied to the pixel regions corresponding to the second gate line "GL2" may be equal to the polarities of the data signal supplied to the pixel regions corresponding to the third gate line "GL3."

As shown in FIG. 5B, the third time period for the odd gate lines such as the first and third gate lines "GL1" and "GL3" is shorter than the fourth time period for the even gate lines such as the second and fourth gate lines "GL2" and "GL4." Since one or more data lines is already charged with the data signal having equal polarities, a pixel electrode (not shown) of the pixel region corresponding to the odd gate lines is sufficiently charged even for the shorter third time period. For example, a data signal supplied to the pixel regions corresponding to the second gate line "GL2" may have the same polarities as the data signal supplied to the pixel regions corresponding to the third gate line "GL3." Accordingly, the data line is already charged with a data signal supplied to the pixel regions corresponding to the second gate line "GL2" and the pixel electrode of the pixel regions corresponding to the third gate line "GL3" can be sufficiently charged even for the shorter third time period.

Furthermore, since the pixel electrodes of the pixel regions corresponding to the odd gate lines are charged with the data signal having equal polarities in the previous frame, the pixel electrodes of the pixel region corresponding to the odd gate lines are sufficiently charged even for the shorter third time period in the present frame. For example, since the pixel electrode of the pixel regions corresponding to the third gate line "GL3" is already charged with a data signal having negative polarity in the third frame, the pixel electrode of the pixel regions corresponding to the third gate line "GL3" may be sufficiently charged with a data signal having negative polarity in the fourth frame even for the shorter third time period.

In a method of driving a LCD device that receives the signals of FIGS. 5A and 5B and generates the polarities of FIGS. 5C to 5F, a data signal having equal polarities is sequentially supplied to the pixel regions corresponding to a pair of adjacent first and second gate lines through one or more data lines. The first pulse time period for which a data signal is supplied to the pixel region corresponding to the first gate line is longer than the second pulse time period for which a data signal is supplied to the pixel region corresponding to the second gate line. Since a data signal is supplied to the pixel region corresponding to the first gate line for the longer first pulse time period, the pixel region corresponding to the first gate line is sufficiently charged with a data signal. Furthermore, since one or more data lines is already charged with a data signal having equal polarities before a data signal is supplied to the pixel region corresponding to the second gate line, the pixel region corresponding to the second gate line is also sufficiently charged with a data signal even for the shorter second pulse time period.

Moreover, between two adjacent frames, the polarities of a data signal supplied to the pixel region corresponding to one of the odd gate lines and the even gate lines are inverted, and the polarities of a data signal supplied to the pixel region corresponding to the other one of the odd gate lines and the even gate lines are not inverted. A data signal is supplied to the pixel region corresponding to the other one of the odd gate lines and the even gate lines where polarities are not inverted for the shorter third time period and a data signal is supplied to the pixel region corresponding to the one of the odd gate lines and the even gate lines where polarities are inverted for the longer fourth time period. Since the pixel electrodes of the pixel regions corresponding to the other one of the odd gate lines and the even gate lines are charged with a data signal having equal polarities in the previous frame, the pixel electrodes of the pixel region corresponding to the other one of the odd gate lines and the even gate lines are sufficiently charged even for the shorter third time period in the present frame. Therefore, the pixel electrode is sufficiently charged even for a shorter time period by pre-charging a data line between gate lines or the pixel electrode between frames.

Figure 6:
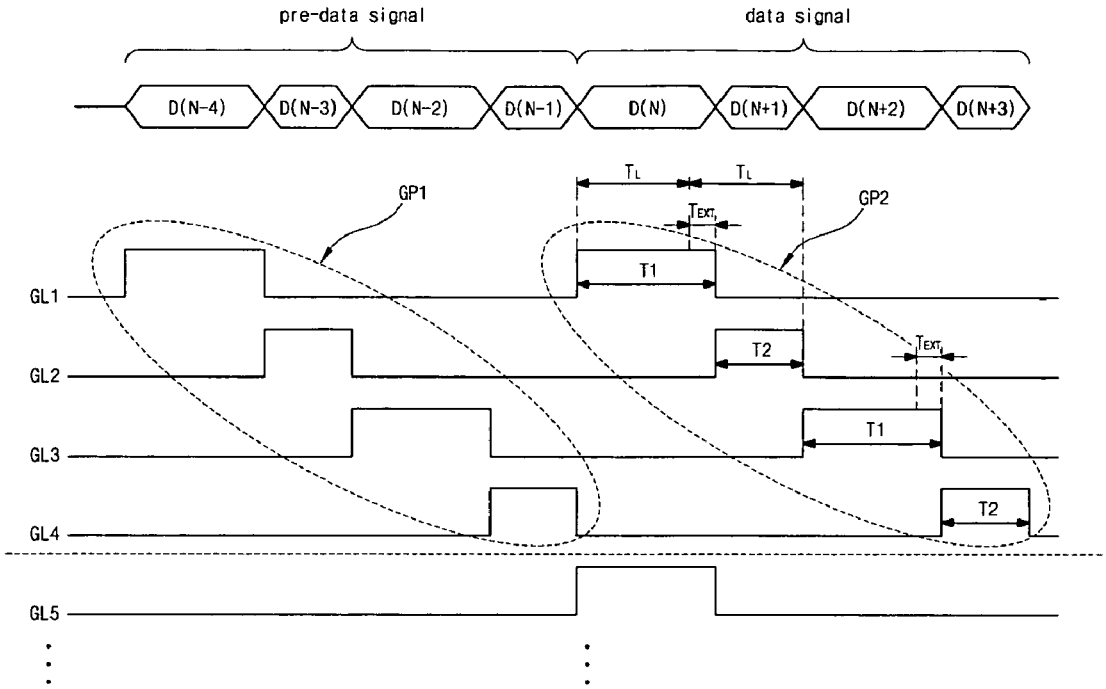
FIG. 6 is a schematic timing chart showing gate signals and data signals for a method of driving a liquid crystal display device according to another embodiment of the present invention.

FIG. 6 is a schematic timing chart showing gate signals and data signals for a method of driving a liquid crystal display device according to another embodiment of the present invention. A LCD device receiving the signals of FIG. 6 includes a plurality of gate lines and a plurality of data lines. In a present frame, a data signal having polarity is supplied to one or more data lines while the gate signal is applied to a pair of adjacent odd and even gate lines. A data signal having opposite polarity is supplied sequentially to one or more data lines while the gate signal is applied to the next pair of adjacent odd and even gate lines as in FIGS. 4B and 4C. For example, a data signal having a positive polarity may be applied to one or more data lines while the gate signal is applied to the first and second gate lines "GL1" and "GL2," and a data signal having a negative polarity may be applied to one or more data lines while the gate signal is applied to the third and fourth gate lines "GL3" and "GL4." In the next frame, the polarities of a data signal are inverted with respect to the present frame. Accordingly, a LCD device is driven by a two-line-frame-inversion method where a polarity of a data signal is inverted every two lines and every frame.

A gate signal is applied to odd gate lines "GL1" and "GL3" for a first pulse time period "T1," and applied to even gate lines "GL2" and "GL4" for a second pulse time period "T2," different from the first pulse time period "T1." For example, the first pulse time period "T1" may be determined as a sum of a single horizontal time period "$T_L$" and an extended time period "$T_{EXT}$" (e.g., T1=$T_L$+$T_{EXT}$), and the second pulse time period "T2" may be determined as a difference between the single horizontal time period "$T_L$" and the extended time period "$T_{EXT}$" (e.g., T2=$T_L$−$T_{EXT}$). Accordingly, a time period for which the gate signal is applied to the odd gate lines is longer than a time period for which the gate signal is applied to the even gate lines. The single horizontal time period "$T_L$" may be obtained by dividing a time period for a single frame into the number of the gate lines. The extended time period "$T_{EXT}$" may vary as a property of a LCD device. Since the gate signal is sequentially applied without cessation to a pair of adjacent odd and even gate lines (e.g., GL1 and GL2) for two horizontal time periods, "$2T_L$," a sum of the first and second pulse time period "T1" and "T2" does not vary even when the extended time period varies.

The polarity of a data signal is inverted every two horizontal lines and in every pixel region "P" along the horizontal line. Furthermore, the polarity of a data signal is inverted in all of the pixel regions "P." Accordingly, the polarity of the data signal is inverted every frame.

A data signal having an equal polarity is supplied to one or more data lines while the gate signal is sequentially applied to a pair of adjacent odd and even gate lines. The gate signal is applied to a first gate line of the pair of adjacent odd and even gate lines for the first pulse time period "T1" longer than the single horizontal time period "$T_L$" (e.g., T1=$T_L$+$T_{EXT}$) and applied to a second gate line of the pair of adjacent odd and even gate lines for the second pulse time period "T2" shorter than the single horizontal time period "$T_L$" (e.g., T2=$T_L$−$T_{EXT}$). Since a data signal having the equal polarity is supplied to one or more data lines for the first pulse time period "T1" longer than the single horizontal time period "$T_L$," the pixel region "P" corresponding to the first gate line is sufficiently charged by a data signal. Furthermore, since a data signal for the first gate line has the same polarity as a data signal for the second gate line, the data lines connected to the second gate line are already partially charged. Accordingly, the pixel region "P" corresponding to the second gate line is also sufficiently charged by a data signal even for the second pulse time period "T2" shorter than the single horizontal time period "$T_L$."

Moreover, a pre-data signal is supplied to one or more data lines when a data signal for the fourth previous gate line is supplied. Accordingly, the gate signal has first and second pulse groups "GP1" and "GP2" having substantially equal durations to each other. For example, the gate signal for an $N^{th}$ gate line may have a first pulse corresponding to the second pulse of the gate signal for an $(N-4)^{th}$ gate line and a second pulse corresponding to the first pulse for an $(N+4)^{th}$ gate line. A data signal for the $(N-4)^{th}$ gate line functions as the pre-data signal for the $N^{th}$ gate line. Since a data signal for the $(N-4)^{th}$ gate line has the same polarity as a data signal for the $N^{th}$ gate line, the pixel electrode corresponding to the $N^{th}$ gate line is pre-charged with the pre-data signal for the $N^{th}$ gate line, i.e., the data signal for the $(N-4)^{th}$ gate line. As a result, every pixel electrode is pre-charged with a data signal for the fourth previous gate line and charged with a data signal for the present gate line. Therefore, the charge property of image of a LCD is further improved.

In a method of driving a LCD device using the schematic timing chart of FIG. 6, a gate signal is sequentially applied to a pair of adjacent odd and even gate lines for two horizontal time periods, while a data signal having equal polarities is supplied to one or more data lines. A data signal is supplied to one or more data lines and a pixel region corresponding to a first gate line for a first pulse time period longer than the single horizontal time period, and is supplied to one or more data lines and a pixel region corresponding to a second gate line for a second pulse time period shorter than the single horizontal time period. Since the pixel region corresponding to the first gate line is charged for the longer first time and one or more data lines are pre-charged with a data signal having equal polarity, the pixel regions corresponding to the first and second gate lines are sufficiently charged. Accordingly, a charge property of a LCD image improved. Moreover, since every pixel electrode is pre-charged with a data signal from the fourth previous gate line and then charged with a data signal from the present gate line, the charge property of a LCD image is further improved.

Even though polarities of a data signal are inverted in every horizontal pixel region in the previous embodiments, the polarities of the data signal may be inverted every several horizontal pixel regions in another embodiment.

For example, when a polarity of a data signal is inverted every frame, the gate signals applied to first and second gate lines may further include pre-gate signals, respectively. At this time, the pre-gate signals are applied to first and second gate lines prior to two-single horizontal time period ($2T_L$) with respect to the gate signals.

Alternatively, when a polarity of a data signal is inverted every two frames, the gate signals applied to first and second gate lines further includes pre-gate signals, respectively. At this time, the pre-gate signals may be applied to first and second gate lines prior to four-single horizontal time period ($4T_L$) with respect to the gate signals. In this case, each of the gate signals applied to each of the plurality of gate lines has a first pulse and a second pulse, and the first and second pulses applied to the same gate line have an equal duration.

In a method of driving a liquid crystal display device, a data signal having equal polarities is supplied to one or more data lines corresponding to a first gate line and a second gate line, and a time for which a gate signal is applied to the first gate line is longer than a time for which a gate signal is applied to the second gate line. Accordingly, one or more data lines are pre-charged when a data signal is supplied and a charge property of a LCD image is improved. Furthermore, since pixel electrodes of the pixel region corresponding to a data signal having a non-inverted polarity are sufficiently charged even for shorter time period in the present frame, the charge property of a LCD image is further improved. Moreover, since every pixel electrode is pre-charged with a data signal from the fourth previous gate line and charged with a data signal from the present gate line, the charge property of a LCD image is further improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device having a plurality of gate lines, a plurality of data lines and a plurality of pixel electrodes, comprising:

applying sequentially a respective gate signal to the plurality of gate lines, the respective gate signal being applied to odd gates lines of the plurality of gate lines for a first pulse time period and being applied to even gate lines of the plurality of gate lines for a second pulse time period different from the first pulse time period; and supplying a respective data signal to the plurality of data lines wherein, an adjacent odd gate line and even gate line constitute a gate line pair, and a polarity of the respective data signal corresponding to the odd gate line of the gate line pair is substantially equal to a polarity of the respective data signal corresponding to the even gate line of the gate line pair, wherein a polarity of the respective data signal corresponding to the gate line pair is substantially opposite to a polarity of the respective data signal corresponding to an adjacent gate line pair, wherein a polarity of the respective data signal is inverted every frame, and wherein the respective gate signals applied to a first gate line and a second gate line of the gate line pair further includes pre-gate signals, and wherein the pre-gate signals are applied to the first gate line and the second gate line prior to two-single horizontal time periods.

2. The method according to claim 1, wherein each gate line and each data line cross each other to define a pixel region, and a thin film transistor is connected to each gate line and each data line.

3. The method according to claim 2, wherein each pixel electrode is disposed in the pixel region and is connected to the thin film transistor.

4. The method according to claim 3, wherein the respective data signal is applied to the plurality of pixel electrodes corresponding to one gate line of the plurality of gate lines while the gate signal is applied to the one gate line.

5. The method according to claim 1, wherein the respective data signal is applied to the plurality of pixel electrodes corresponding to one gate line of the plurality of gate lines while the gate signal is applied to the one gate line.

6. The method according to claim 1, wherein the first pulse time period is longer than a single horizontal time period obtained by dividing a time period for a single frame into a number of the plurality of gate lines, and the second pulse time period is shorter than the single horizontal time period.

7. The method according to claim 6, wherein the first time period is substantially equal to a sum of the single horizontal time period and an extended time period, and the second pulse time period is substantially equal to a difference between the single horizontal time period and the extended time period.

8. The method according to claim 1, wherein the first pulse time period is shorter than a single horizontal time period obtained by dividing a time period for a single frame into a number of the plurality of gate lines, and the second pulse time period is longer than the single horizontal time period.

9. The method according to claim 8, wherein the first time period is substantially equal to a sum of the single horizontal time period and an extended time period, and the second pulse time period is substantially equal to a difference between the single horizontal time period and the extended time period.

10. The method according to claim 1, wherein the respective gate signal applied to the plurality of gate lines has a first pulse group and a second pulse group, and wherein the first pulse group and the second pulse group have substantially equal durations.

11. The method according to claim 10, wherein the first pulse of the respective gate signal applied to one of the plurality of gate lines coincides with the second pulse of the gate signal applied to a fourth previous one of the plurality of gate lines, and the second pulse of the gate signal applied to one of the plurality of gate lines coincides with the first pulse of the gate signal applied to a fourth next one of the plurality of gate lines.

12. A method of driving a liquid crystal display device having a plurality of gate lines, a plurality of data lines and a plurality of pixel electrodes, comprising:

applying sequentially a respective gate signal to the plurality of gate lines, the respective gate signal being applied to odd gates lines of the plurality of gate lines for a first pulse time period and being applied to even gate lines of the plurality of gate lines for a second pulse time period different from the first pulse time period; and supplying a respective data signal to the plurality of data lines wherein an adjacent odd gate line and even gate line constitute a gate line pair, and a polarity of the respective data signal corresponding to the odd gate line of the gate line pair is substantially equal to a polarity of the respective data signal corresponding to the even gate line of the gate line pair, wherein a polarity of the respective data signal corresponding to the gate line pair is substantially opposite to a polarity of the respective data signal corresponding to an adjacent gate line pair, wherein a polarity of the respective data signal is inverted every two frames, and wherein the respective gate signals applied to a first gate line and a second gate line of the gate line pair further includes pre-gate signals, and wherein the pre-gate signals are applied to the first gate line and the second gate line prior to four-single horizontal time periods.

13. The method according to claim 12, wherein the respective gate signal applied to the plurality of gate lines has a first pulse and a second pulse, and wherein the first pulse and the second pulse applied to the same gate line have an equal duration.

14. The method according to claim 12, wherein a polarity of the respective data signal corresponding to only one of the gate line pair is inverted between two continuous frames.

* * * * *